US007504955B2

(12) United States Patent
Overturf

(10) Patent No.: US 7,504,955 B2
(45) Date of Patent: Mar. 17, 2009

(54) PRESSURE RELIEF REMINDER AND ASSOCIATED METHOD FOR THE PREVENTION OF PRESSURE SORES

(76) Inventor: Donald W. Overturf, 203 Cove Rd., Greenwood, SC (US) 29646

( * ) Notice: Subject to any disclaimer, the term of this patent is extended or adjusted under 35 U.S.C. 154(b) by 169 days.

(21) Appl. No.: 11/347,485

(22) Filed: Feb. 3, 2006

(65) Prior Publication Data

US 2007/0182570 A1 Aug. 9, 2007

(51) Int. Cl.
*G08B 23/00* (2006.01)

(52) U.S. Cl. ..... 340/573.1; 340/573.7

(58) Field of Classification Search ..... 340/573.1, 340/573.7; 600/595
See application file for complete search history.

(56) References Cited

U.S. PATENT DOCUMENTS 4,084,274 A * 4/1978 Willis et al. ..... 5/609
4,554,930 A 11/1985 Kress
4,574,901 A * 3/1986 Joyner ..... 180/65.1
4,633,237 A * 12/1986 Tucknott et al. ..... 340/573.4
4,796,948 A 1/1989 Paul et al.
5,083,551 A * 1/1992 Addison, Jr. ..... 601/61
5,230,113 A 7/1993 Foster et al.
5,583,832 A 12/1996 DePonty
6,014,346 A 1/2000 Malone
6,030,351 A * 2/2000 Schmidt et al. ..... 600/592
6,129,686 A * 10/2000 Friedman ..... 600/595
6,216,299 B1 4/2001 Kohlman
6,384,728 B1 5/2002 Kanor et al.
6,426,719 B1 * 7/2002 Nagareda et al. ..... 342/357.06
6,557,937 B1 * 5/2003 Shah et al. ..... 297/284.3
6,646,556 B1 * 11/2003 Smith et al. ..... 340/573.1
6,715,784 B2 4/2004 Koerlin et al.
6,788,976 B2 * 9/2004 Gesotti ..... 607/49
7,027,358 B1 * 4/2006 Esposito et al. ..... 368/10
7,127,370 B2 * 10/2006 Kelly et al. ..... 702/151
2003/0090089 A1 * 5/2003 Koerlin et al. ..... 280/650
2004/0046668 A1 3/2004 Smith et al.
2005/0121959 A1 * 6/2005 Kruse et al. ..... 297/330
2005/0268401 A1 * 12/2005 Dixon et al. ..... 5/655.3
2006/0195051 A1 * 8/2006 Schnapp et al. ..... 600/595
2007/0073196 A1 * 3/2007 Tanaka et al. ..... 600/595

FOREIGN PATENT DOCUMENTS

GB 2103853 2/1983

* cited by examiner

*Primary Examiner*—Jeff Hofsass
*Assistant Examiner*—Kerri McNally
(74) *Attorney, Agent, or Firm*—J. Bennett Mullinax, LLC

(57) ABSTRACT

An apparatus and method for preventing the formation of pressure sores on the skin of an individual is provided. The apparatus includes an inclination sensor for detecting a change in inclination of an object holding the individual. A microprocessor is in communication with the inclination sensor and generates an indication signal at the end of a timing cycle. The microprocessor resets the timing cycle based upon input from the inclination sensor. An indicator is in communication with the microprocessor and alerts the individual of the need to relieve pressure on certain areas of the skin of the individual upon receiving the indication signal.

17 Claims, 8 Drawing Sheets

PRESSURE RELIEF REMINDER AND ASSOCIATED METHOD FOR THE PREVENTION OF PRESSURE SORES

FIELD OF THE INVENTION

The present invention relates generally to a device and method for the prevention of pressure sores. More particularly, the present application involves a pressure relief reminder that alerts an individual of the need to change the inclination of his or her wheelchair in order to avoid the formation of pressure sores.

BACKGROUND

People confined to a bed or wheelchair are susceptible to decubitus ulcers, commonly known as pressure or bedsores. Sitting or lying in bed for an excessive duration of time exerts a certain degree of pressure to an area of the person's skin. This excessive pressure occludes the person's capillaries and cuts off the supply of blood to his or her tissue thus causing the aforementioned sores. Pressure sores can cause tissue necrosis and can damage muscle, bone and supporting structure, and as such can be a severe medical problem and life threatening. Fortunately, pressure sores can be avoided by simply alleviating pressure on an individual's skin through movement or weight shifting.

People that have a normal range of motion and normal sensation will experience discomfort and adjust or shift their weight prior to the formation of pressure sores. Individuals confined to a wheelchair, paraplegics or quadriplegics for example, may be capable of shifting their weight but may not have adequate sensation to know when to perform such a weight shift. It is therefore desirable that some form of external signal be communicated to people in wheelchairs to inform them that it is time to perform a weight shift in order to prevent pressure sores from forming.

Learning how to perform weight shifts on a regular basis is part of the rehabilitative process for individuals who have been recently injured. Individuals are often given simple kitchen timers to help remind them to perform weight shifts. The individual resets the timer once time expires. Although adequate in a clinical setting, such a timer becomes impractical once the individual is released. Additionally, some individuals do not possess adequate hand function to manually reset such a timer.

Wheelchairs often have a seat made of a seating surface and a back frame. The seating surface is usually either horizontal or inclined slightly backwards from the front of the seating surface to the back of the seating surface. In order to shift the weight of the person in the wheelchair, the seat may be tilted so that the weight of the user on his or her pressure points, typically the buttocks, legs, and/or back, is relieved. In this regard, both the seating surface and the back frame may be tilted backwards simultaneously. Alternatively, only the back frame or the seating surface may be tilted.

Prior devices that have been developed in order to prevent the formation of pressure sores include cushion systems that are inflatable. These cushion systems employ air bags that can be inflated to different pressures or inflated at different locations on the wheelchair. Cushion systems thus seek to alternate the pressure points upon the individual's body thus reducing the occurrence of pressure sores. Prior devices have also been proposed that measure the amount of movement of the individual within his or her wheelchair. If an insufficient amount of movement is detected, the system assumes that the individual is not shifting his or her weight enough within the wheelchair and an alarm goes off informing the individual that a weight shift must be performed. Additional devices have been proposed that measure the amount of pressure the individual exerts onto the seat for a given time. If the amount of pressure for a given time is attained, the device signals the individual that it is time to perform a weight shift.

Previous attempts to reduce the formation of pressure sores, while enjoying a degree of success, are either too costly or are not easy to utilize over extended periods of time. Additionally, these systems are often complicated and signal alerts based upon a variety of detection parameters thus increasing the chances that the system may fail to issue a required alarm. Previous systems are not conservative in that they are designed to signal an alarm based on analyzing multiple conditions, such as pressure and time, to determine if these conditions justify issuing an alert. Although weight shifting is a good way to prevent pressure sores, to be effective the practice must become a habit.

As such, previous systems do not constantly signal an alert to an individual at predetermined time periods to ensure that weight shifting is being performed and to instill a sense of repetition so that constant weight shifting will become repetitious and hence second nature.

Accordingly, there remains room for variation and improvement within the art.

SUMMARY

Various features and advantages of the invention will be set forth in part in the following description, or may be obvious from the description, or may be learned from practice of the invention.

The present invention provides for an apparatus and method for preventing the formation of pressure sores on the skin of an individual. The apparatus includes an inclination sensor that can detect a change in inclination of the object holding the individual, and an indicator for alerting the individual of the need to relieve pressure on certain areas of his or her skin.

In accordance with one exemplary embodiment of the present invention, the apparatus includes an inclination sensor for detecting a change in inclination, and a microprocessor in communication with the inclination sensor. The microprocessor is configured for generating an indication signal at the end of a timing cycle, and the microprocessor is also configured for resetting the timing cycle based upon input from the inclination sensor. An indicator is present and is in communication with the microprocessor. Upon receiving the indication signal, the indicator is configured for alerting the individual of the need to relieve pressure.

The present invention also provides for an apparatus as discussed above in which the inclination sensor is a tilt switch. Alternatively, the apparatus as discussed above may an inclination sensor that is an accelerometer.

In accordance with one aspect of the present invention, the apparatus as discussed above functions so that the indication signal is generated based solely upon the parameters of time and inclination.

A further exemplary embodiment of the apparatus exists as discussed above in which resetting of the timing cycle is based solely upon input from the inclination sensor.

An additional exemplary embodiment of the apparatus exists as previously discussed in which a frame is also included. The frame carries the inclination sensor, microprocessor and indicator. Further, the frame is configured for attachment to a wheelchair so that the apparatus in turn is carried by the wheelchair.

The present invention also provides for an apparatus for preventing the formation of pressure sores that includes a frame that is configured for attachment to a wheelchair. The wheelchair is capable of moving from a nontilted position to a tilted position so that the frame is in turn capable of moving from a nontilted to a tilted position. An inclination sensor configured for detecting a change in inclination is also present and is carried by the frame. The frame further carries a microprocessor that is in communication with the inclination sensor. The microprocessor is configured for generating an indication signal at the end of a timing cycle. The microprocessor receives input from the inclination sensor for use in determining inclination information about the frame. An indicator is in communication with the microprocessor and is configured for alerting the individual upon receiving the indication signal. The indicator alerts the individual of the need to tilt the wheelchair in order to relieve pressure on certain areas of the skin of the individual. A battery is carried by the frame and is used to supply power to the microprocessor.

An additional aspect of the invention exists in an apparatus as immediately discussed in which the microprocessor prevents the indication signal from being generated when the frame is in the tilted position. Further, the timing cycle is reset after the frame moves from the nontilted position to the tilted position. In this regard, the timing cycle may reset immediately upon moving from the nontilted to the tilted position, or the timing cycle may reset once the wheelchair returns to the nontilted position from the tilted position, or the timing cycle may reset at points in between.

A further exemplary embodiment exists in an apparatus as immediately discussed in which generation of the indication signal is based solely upon the parameters of time and inclination of the frame.

The present invention also provides for a method of alerting an individual of the need to tilt a wheelchair in order to prevent the formation of pressure sores on the skin of the individual. The method includes the step of sensing whether the wheelchair is in a nontilted position. The method also includes the step of detecting the time spent by the wheelchair in the nontilted position. An indication signal is generated based upon the expiration of a predetermined amount of time that the wheelchair is in the nontilted position. The individual is alerted through use of an indicator upon receiving the indication signal.

A further aspect of the present invention exists in a method as previously discussed in which the step of generating the indication signal is based solely upon the parameters of time and inclination.

An additional aspect of the present invention exists in a method as discussed above that further includes the steps of tilting the wheelchair to a tilted position and sensing the repositioning thereof. The steps of returning the wheelchair to the nontilted position and sensing this return are also included. A further step of resetting the timing cycle is present. The timing cycle is reset upon returning the wheelchair to the nontilted position so that the generating step is performed based upon the expiration of a predetermined amount of time that the wheelchair is in the nontilted position.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
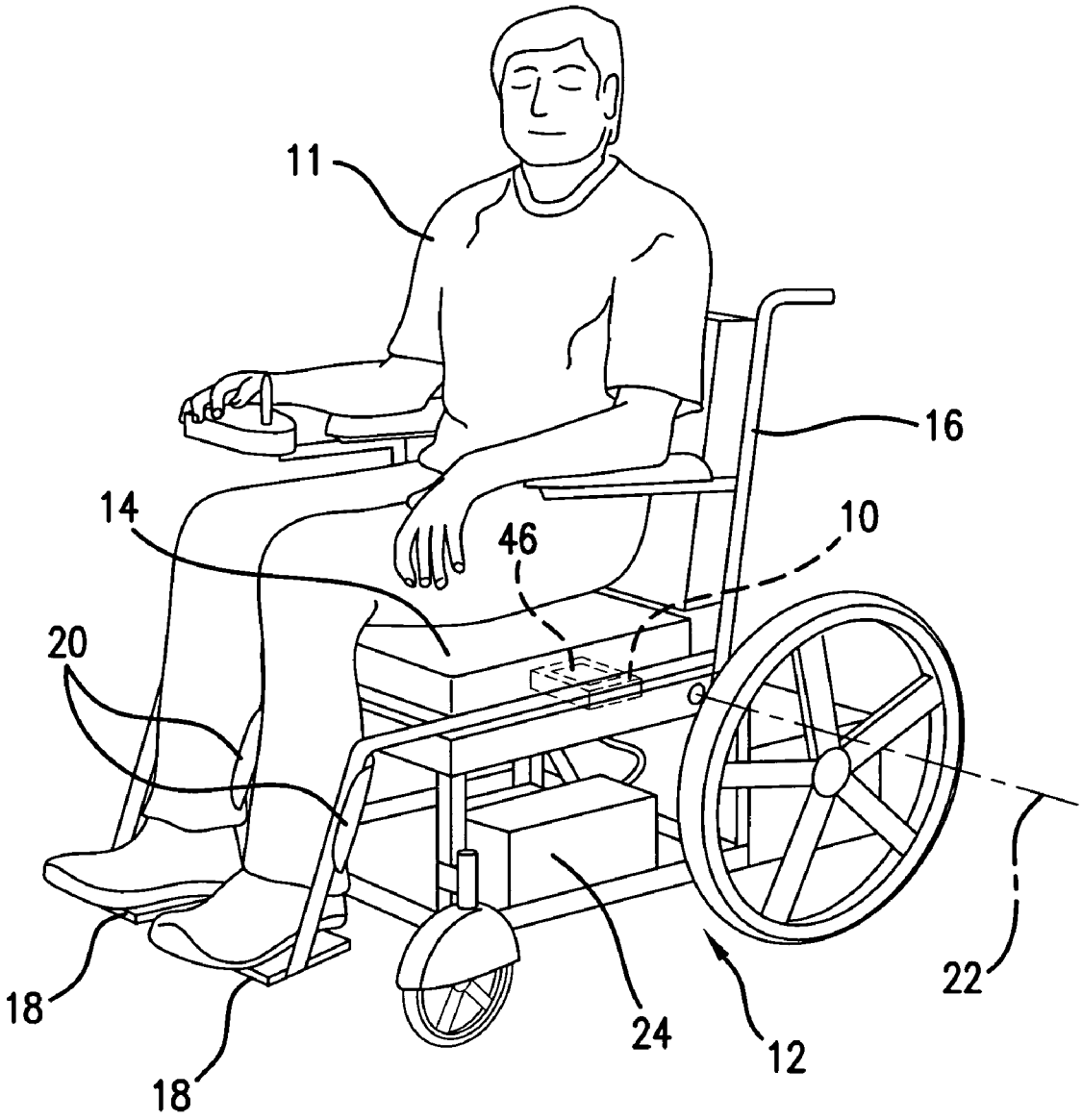
FIG. 1 is a perspective view of a pressure relief reminder attached underneath the seat of a wheelchair in a nontilted position in accordance with one exemplary embodiment of the present invention.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162.Further, all limits mentioned herein include all other limits included in the mentioned limits. For instance, a limit of up to about 7 also includes a limit of up to about 5, up to about 3, and up to about 4.5.

The present invention provides a pressure relief reminder apparatus 10 that is used for preventing the formation of pressure sores on the skin of an individual 11. The apparatus 10 includes an indicator 40 that alerts the individual 11 that it is time to perform a weight shift in order to relieve pressure on certain areas of the individual's body to prevent pressure sores from forming. The apparatus 10 has a microprocessor 38 that receives input from an inclination sensor 36 and causes the indicator 40 to alarm once a prescribed period of time has elapsed. The apparatus 10 is designed to be used with a wheelchair 12, bed, or other structure capable of tilting so that when alerted the individual 11 can perform a tilt function in order to accomplish the aforementioned weight shift and prevent the formation of pressure sores.

The apparatus 10 is used in connection with a wheelchair 12 in FIG. 1. The apparatus 10 may be used with any variety of wheelchairs 12 capable of tilting as known in the art. The wheelchair 12 has a seat 14 that supports the thighs and buttocks of the individual 11 when in the wheelchair 12 is in the nontilted position. A back frame 16 is present for supporting the back of the individual 12. Additional supports are incorporated into the wheelchair 12 for supporting other portions of the individual's body. As shown, a foot rest 18 and leg support 20 are included in order to support the feet and legs of the individual 11.

Figure 2:
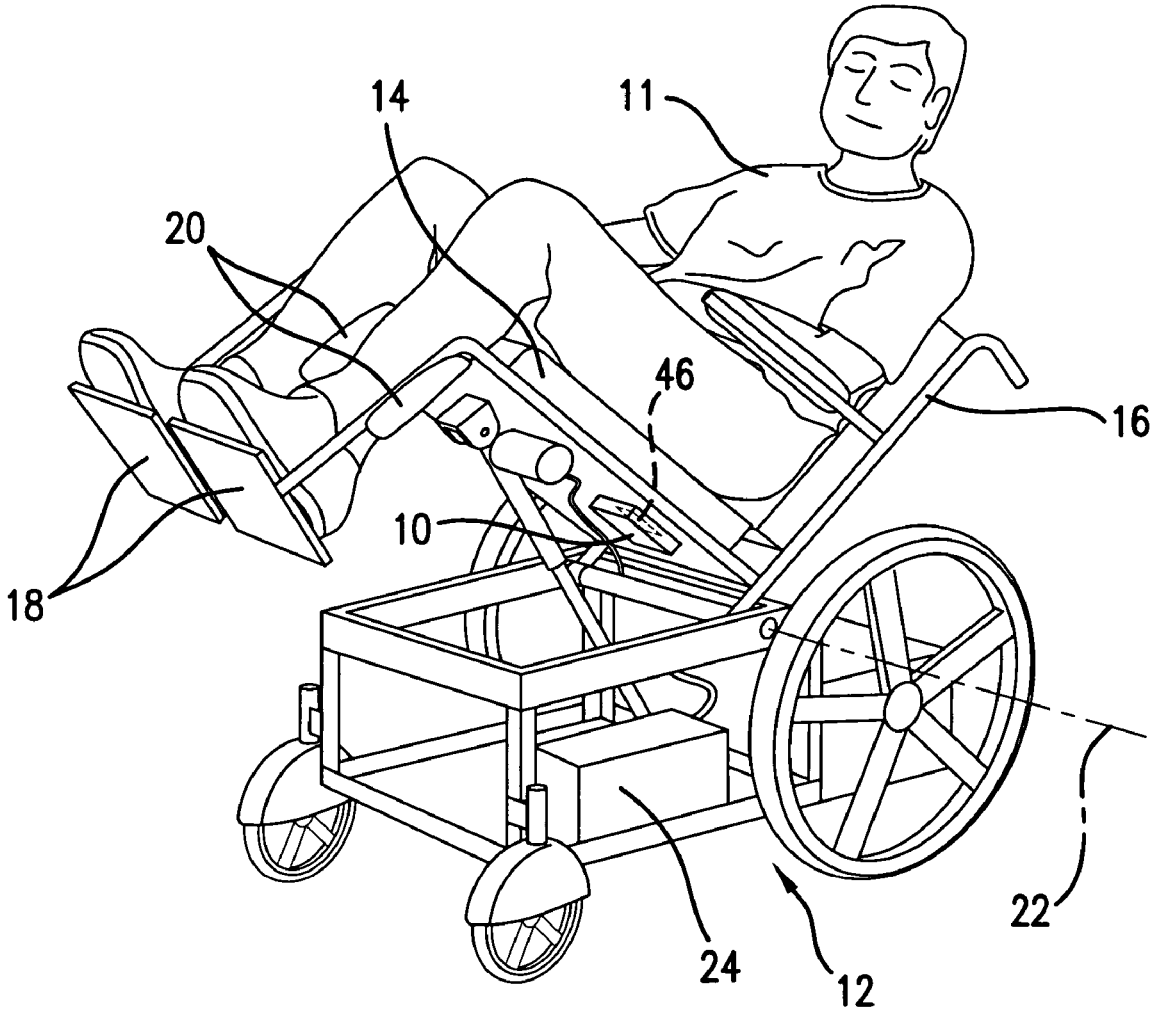
FIG. 2 is a perspective view of the wheelchair of FIG. 1 shown in a tilted position.

The wheelchair 12 includes a tilt function that allows the wheelchair 12 to tilt in order to provide pressure relief to the individual 11 as shown in FIG. 2. In this regard, the seat 12, back frame 16, foot rest 18 and leg support 20 are all pivotable about an axis 22. A motor 24 is present and is used to drive a linkage (not shown) that pivots the aforementioned portions of wheelchair 12 about axis 22 and into the tilted position shown in FIG. 2. Once the individual 11 is placed into the tilted position, pressure is transferred to the back of the individual 11 and pressure relief occurs between the seat 14 and the ischial bones so that pressure sores do not form on the skin of the individual 11 in this area.

Additional pressure relief may also be realized upon adjusting the wheelchair 12 to the position shown in FIG. 2. For example, pressure on the feet or legs of the individual 11 may potentially be relived as the weight on these body parts may also be adjusted upon tilting. Although described as employing a motor 24 and linkage, a variety of mechanisms may be used in order to tilt the wheelchair 12. For instance, a hydraulic or pneumatic cylinder may be used to tilt the seat 14, back frame 16, foot rest 18 and leg support 20 about axis 22. Further, it is to be understood that the seat 14 and other components of the wheelchair 12 may in fact have some degree of tilt associated with them when in the nontilted position. In this regard, the tilted position of the wheelchair 12 is the position in which the wheelchair is moved in order to perform a weight shift, and the nontilted position is the position in which the wheelchair 12 is primarily kept by the individual 11.

The apparatus 10 is mounted underneath the seat 14 of the wheelchair 12. The apparatus 10 is removably mounted to the wheelchair 12 by use of a hook and loop type fastener 46. The mounting location may be cleaned with alcohol before applying one of the hook and loop type fastener 46 components thereon. The apparatus 10 may be removed from the wheelchair 12 when the wheelchair 12 is not used, and the apparatus 10 may be placed onto a different wheelchair or other structure used to hold the individual 11. It is to be understood, however, that the apparatus 10 is permanently mounted to the wheelchair 12 in other exemplary embodiments.

The apparatus 10 is mounted at a location on the wheelchair 12 so that tilting of the wheelchair 12 does not cause the apparatus 10 to interfere with other components of the wheelchair 12. Additionally, the mounting location of the apparatus 10 may be selected so that tools do not have to be employed in order to access the apparatus 10. Although shown mounted beneath the seat 14, the apparatus 10 may be mounted to other parts of the apparatus 10 that are put into motion during a weigh shift in accordance with other exemplary embodiments such as the back frame 16, arm rests, foot rest 18, or leg support 20. Aside from the use of the hook and loop type fastener 46, the apparatus 10 may be attached to the wheelchair 12 in a variety of manners. For example, the apparatus 10 may be attached through the use of adhesives, mechanical fasteners, or may be placed into a pocket or other receptacle of the wheelchair 12 in other embodiments.

Figure 3:
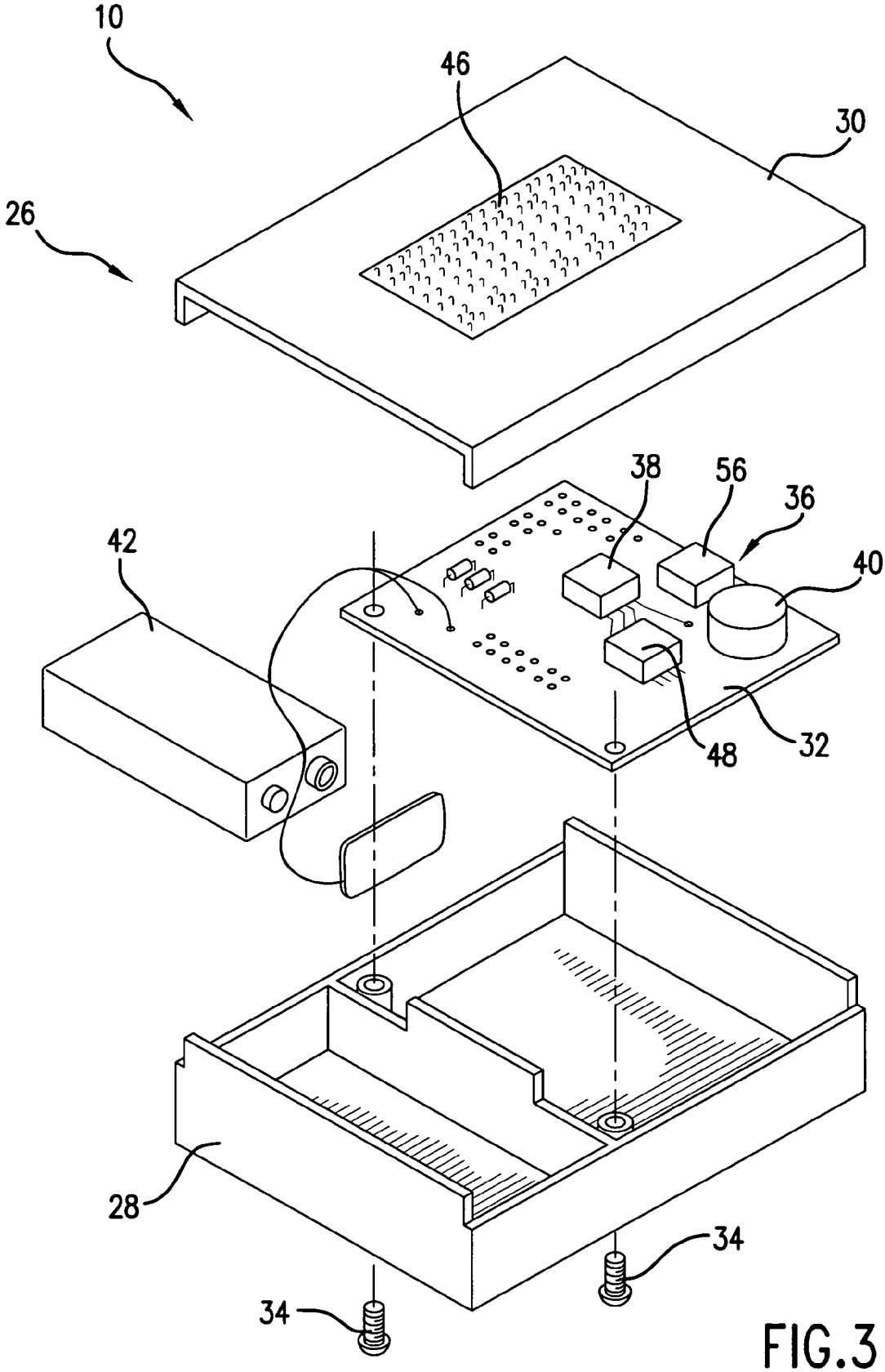
FIG. 3 is an exploded assembly view of a pressure relief reminder in accordance with one exemplary embodiment of the present invention.

The apparatus 10 includes a frame 26 that has a base 28 and a cover 30 as shown in FIG. 3. The frame 26 may be made of plastic and is used to carry and protect various components of the apparatus 10 in addition to providing a surface on which to mount the apparatus 10 to the wheelchair 12 by way of the hook and loop type fastener 46. A printed circuit board 32 is mounted to the base 28 through use of a pair of screws 34 that are also used to hold the base 28 and cover 30 together. A combination of surface mounts and through-hole components may be carried by the printed circuit board 32. A battery 42 that powers the apparatus 10 is housed in the frame 26 and may be accessed through a battery door as is commonly known in the art.

Figure 4:
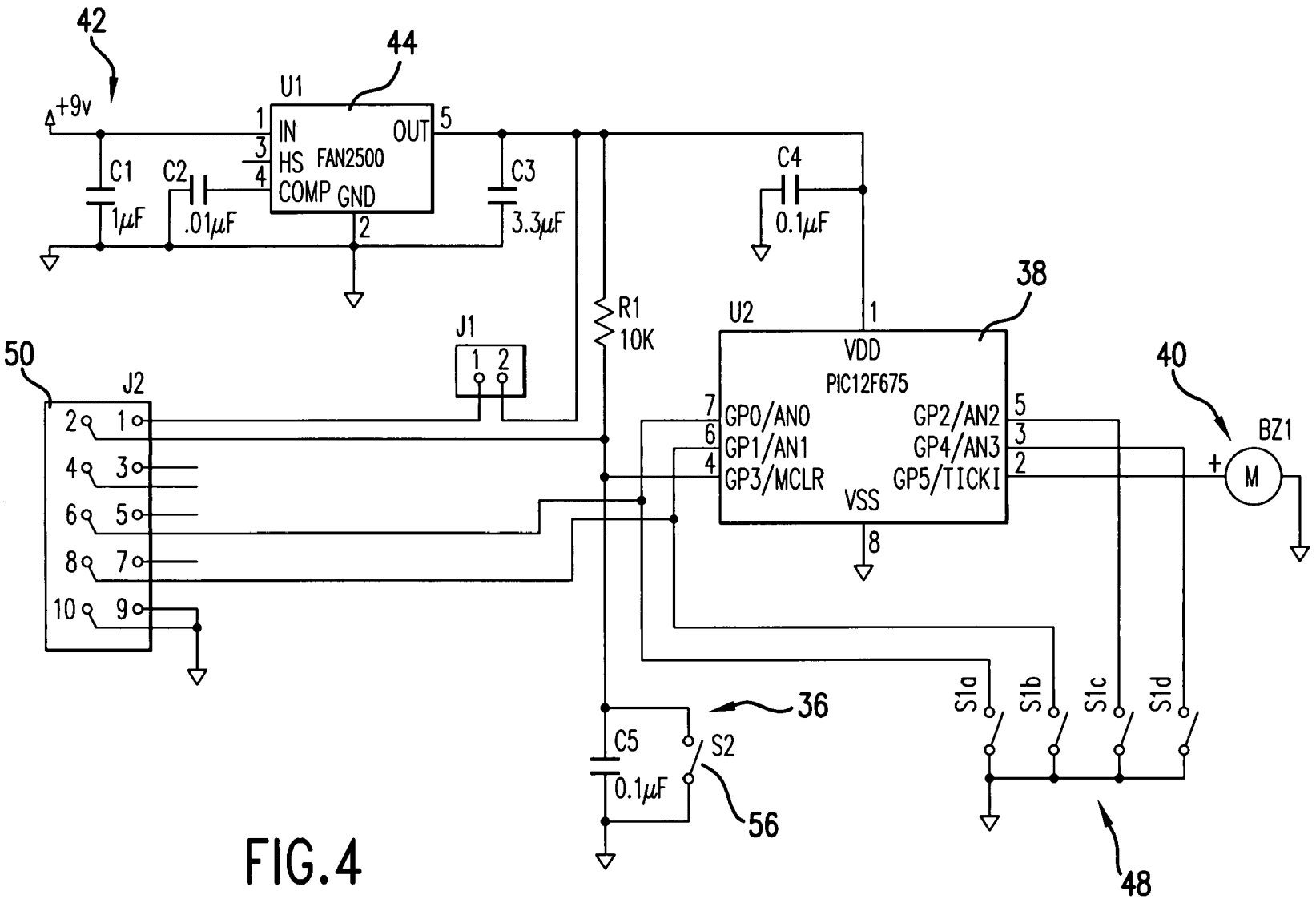
FIG. 4 is an electrical schematic diagram of an exemplary embodiment of the pressure relief reminder that employs a tilt switch.

A circuit diagram of one exemplary embodiment of the apparatus 10 is shown in FIG. 4. A voltage regulator 44 is used to regulate the amount of voltage supplied by the battery 42 to components of the apparatus 10. In accordance with one exemplary embodiment, the battery 42 is a nine volt battery and the voltage regulator 44 is a low dropout voltage regulator that regulates the nine volts supplied by the battery 42 to five volts. As a low dropout voltage regulator 44 is used, the input to output voltage differential allows extended operation down to approximately five and a half volts in order to extend the battery life of the apparatus 10 considerably compared to typical linear regulators. Such a configuration achieves a battery life of approximately two months from a single nine volt battery 42. However, it is to be understood that the voltage regulator 44 may be configured differently or eliminated in accordance with other exemplary embodiments.

The apparatus 10 includes a microprocessor 38 that is used in conjunction with an inclination sensor 36 and an indicator 40. The inclination sensor 36 may be any type of inclinometer. An inclinometer is an instrument that is used for measuring angles of slope, elevation or inclination of an object with respect to gravity. The inclination sensor 36 used in the exemplary embodiment shown in FIG. 4 is a tilt switch 56. Any suitable tilt switch 56 may be used in accordance with various exemplary embodiments of the present invention as the inclination sensor 36. For example, the tilt switch 56 may be a series 107-1006 or 107-1007 tilt switch, or the tilt switch 56 may be a series 107-1003 glass bulb tilt switch manufactured by Mountain Switch and distributed by Mouser Electronics, Inc. having offices at 1000 North Main Street, Mansfield, Tex. 76063. The tilt switch 56 is capable of determining a change in inclination and sending this information to the microprocessor 38. Such tilt switches 56 typically employ a copper ball that rolls inside of a housing and causes two terminals to be in electrical contact when positioned at a certain inclination. In certain embodiments, the tilt switch 56 may generate an artificial horizon and measure angular tilt with respect to this horizon.

It is sometimes the case that the wheelchair 12 has a seat 14 with a built-in negative slope. In this instance, the tilt switch 56 is mounted at a slight angle in order to compensate for the existing slope of seat 14. The tilt switch 56 can be either mounted at an angle on the printed circuit board 32, or the entire apparatus 10 may be mounted at an angle on the bottom of the seat 14 in order to accommodate the existing slope of seat 14. Further, when employing certain types of tilt switches 56, the apparatus 10 must be correctly oriented with respect to the wheelchair 12 in order to ensure the tilt switch 56 functions correctly.

A timer is implemented in software as part of the program of the microprocessor 38. After a certain amount of time has elapsed, the microprocessor 38 sends an indication signal to the indicator 40. Referring now to both FIGS. 1 and 4, the indicator 40 in turn alerts the individual 11 that a certain amount of time has elapsed and it is therefore necessary to tilt the wheelchair 12 in order to prevent pressure sores from forming. The microprocessor 38 receives input from the tilt switch 56 in order to ascertain whether the wheelchair 12 is nontilted or tilted. Based upon tilt information and time information, the microprocessor 38 may be variously configured in order to determine whether an alert via indicator 40 should be issued to the individual 11. In certain exemplary embodiments, the apparatus 10 is arranged so that the indicator 40 issues an alert to the individual 11 based solely upon the parameters of time and inclination.

In accordance with one exemplary embodiment of the present invention, the apparatus 10 is designed for use by individuals 11 that are without hand function. In this instance, the apparatus 10 is a hands-free pressure relief reminder that alerts based upon only parameters of time and inclination. After a certain amount of time has elapsed, the microprocessor 38 generates the indication signal that in turn causes the indicator 40 to alert the individual 11 of the need to perform a weight shift. The indicator 40 can issue an audible beep, can vibrate, or can optically alert the individual 11 in accordance with various exemplary embodiments. In certain embodiments, the output of the indicator 40 may be chosen so the individual 11 can switch from between a vibration alert, an audible alert, and a combined vibration and audible alert. The indicator 40 may issue an alert immediately upon receiving the indication signal from the microprocessor 38.

The individual 11 may move the wheelchair 12 to the tilted position in order to perform the required weigh shift and at such time the inclination sensor 36 signals the microprocessor 38 that the wheelchair 12 has entered the tilted position. At this time, the microprocessor 38 is in a reset condition and waits until the individual 11 holds the wheelchair 12 in the tilted position for the amount of time as may be recommended by his or her physician. Upon repositioning the wheelchair 12 back into the nontilted position, the inclination sensor 36 senses this change in inclination and the microprocessor 38 may once again reinitiate the timing cycle for signaling future alerts to the individual 11. Such a configuration allows the apparatus 10 to function without the need to manually reset the timing cycle. Additionally, the apparatus 10 can be configured so that the timing cycle of the microprocessor 38 is reset whenever a change in inclination occurs through tilting of the wheelchair 12 regardless of whether the indicator 40 has alerted the individual 11.

The apparatus 10 may be provided so that it is initially in a sleep mode and powers on when detecting that the wheelchair 12 is moved into the tilted position. The timing cycle may then reset once the individual 11 enters the nontilted position and then the apparatus 10 may issue an alert once the timing cycle is complete. If the wheelchair 12 is not tilted after the indicator 40 signals an alert, the microprocessor 38 may then generate another indication signal after one minute of time in which the indicator 40 may emit a longer beep. Repeat reminders may occur every minute for five minutes at which time the apparatus 10 will end the timing cycle and cease to alert the individual 11 thus entering the sleep mode as described above. At any point in time during the one minute interval stage the wheelchair 12 may be tilted in order to stop the indicator 40 from alerting. Alternative ways of configuring the apparatus 10 are possible as is known in the art and as described below.

Figure 5:
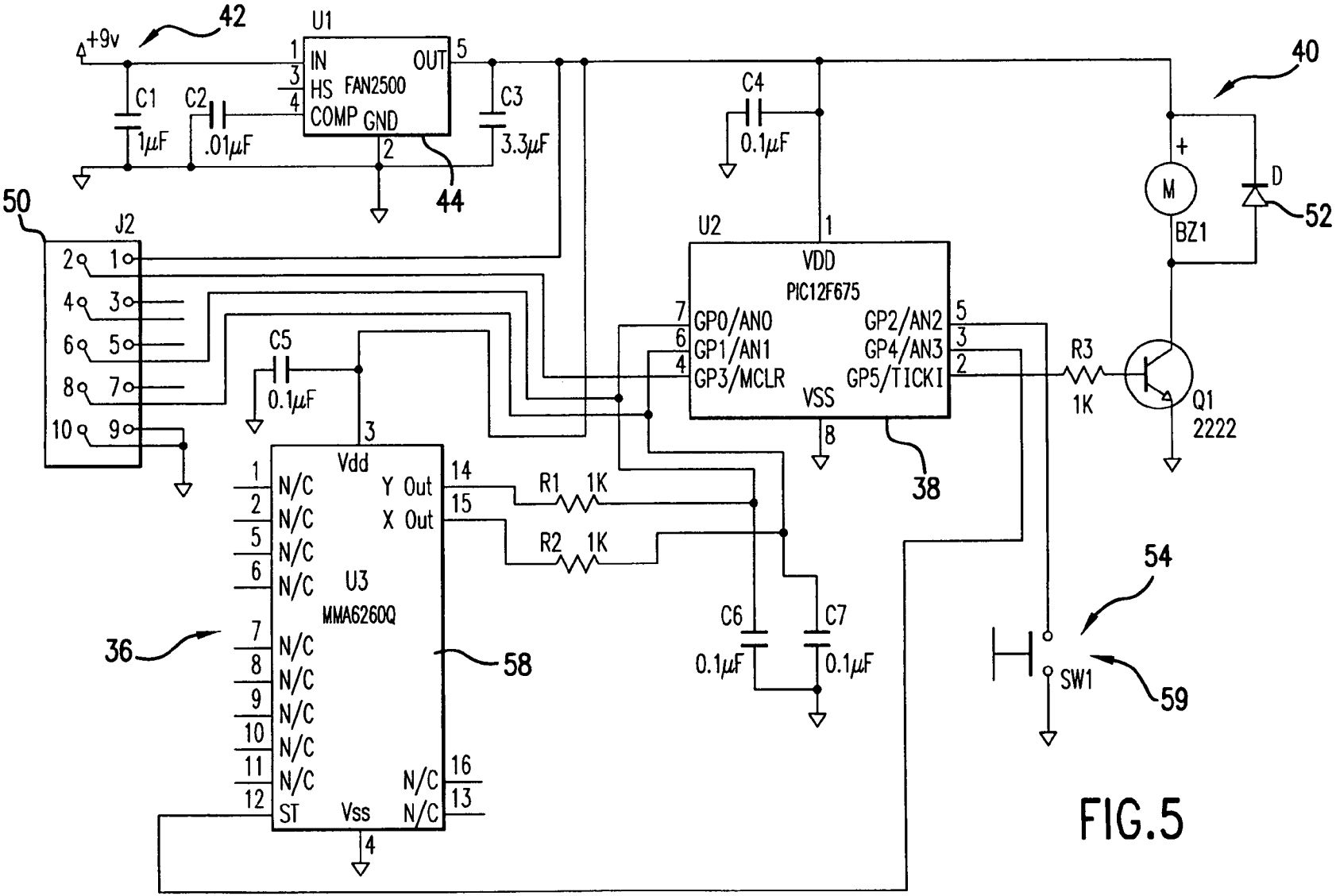
FIG. 5 is an electrical schematic diagram of an exemplary embodiment of the pressure relief reminder that employs an accelerometer.

Although described as being a tilt switch 56, the inclination sensor 36 can be an accelerometer 58 in accordance with other exemplary embodiments. FIG. 5 is an electrical schematic diagram of the apparatus 10 in which an accelerometer 58 is used to supply inclination information to the microprocessor 38. The accelerometer 58 may be a MMA6260Q accelerometer that is provided by Freescale Semiconductor, Inc. with corporate headquarters at 6501 William Cannon Drive West, Austin, Tex. 78735. Any type of accelerometer 58 can be used to supply information to the microprocessor 38. For example, the accelerometer 58 may be a dynamic accelerometer in that inclination information is sent to the microprocessor 38 during tilting of the wheelchair 12. Alternatively, the accelerometer 58 can be a static accelerometer 58 so that inclination information is sent based upon the inclination of the accelerometer 58 with respect to the Earth's field of gravity. Accelerometers are commonly known as instruments for measuring acceleration, detecting and measuring vibrations, or for measuring acceleration due to gravity (inclination).

The exemplary embodiment of FIG. 4 may additionally incorporate a reset button 54. The reset button 54 can be actuated in order to restart the timing cycle of the microprocessor 38. The reset button 54 can be used by an individual 11 who has adequate hand function or by a medical care giver if a reset of the timing cycle of the apparatus 10 is desired. The reset button 54 may be included in conjunction with, or in lieu of, the tilt switch 56. However, the timing cycle can be reset upon input of the tilt switch 56 in the previously described manner in case the individual 11 does not possess adequate hand function to actuate the reset button 54. Upon expiration of a certain period of time, the microprocessor 38 sends an indication signal to an indicator 40 that is in this instance a buzzer that vibrates to alert the individual of the need to tilt the wheelchair 12.

The exemplary embodiment of FIG. 5 incorporates a programming button 59. This button is used to initially set certain parameters such as the mode of operation, the amount of time that is to elapse before an alert is issued and other parameters. The programming button 59 may also be used as a reset button 54. In this mode, the reset button 54 can be actuated in order to restart the timing cycle of the microprocessor 38. The reset button 54 can be used by an individual 11 who has adequate hand function or by a medical care giver if a reset of the timing cycle of the apparatus 10 is desired. The reset button may be included in conjunction with, or in lieu of, the tilt switch 56. However, the timing cycle can be reset upon input of the accelerometer 58 in the previously described manner in case the individual 11 does not possess adequate hand function to actuate the reset button 54. Upon expiration of a certain period of time, the microprocessor 38 sends an indication signal to an indicator 40 that is in this instance a buzzer that vibrates to alert the individual of the need to tilt the wheelchair 12. A diode 52 is used in the event of an inductive signaling device such as a vibrating motor. The diode 52 protects the circuitry from a voltage spike that would otherwise be generated when the signaling device is switched off.

A programming port 50 is present in both the exemplary embodiments shown in FIGS. 4 and 5. The programming port 50 is used to program the microprocessor 38 so that the apparatus 10 can function in a desired manner. For example, the programming port 50 may be used to set the length of the timing cycle, adjust the number of alerts that occur before the apparatus 10 enters the sleep mode, or to modify other logic of the apparatus 10. The programming port 50 may also be used to export information from the microprocessor 38 in certain exemplary embodiments. For example, the number of weight shifts or the length of time of each weight shift may be retrieved from the microprocessor 38 in certain embodiments.

The exemplary embodiment of FIG. 4 also has a four position DIP switch 48 that may also be used to set certain values in the apparatus 10. The apparatus 10 may be configured so that upon start up the microprocessor 38 reads the status of the DIP switch 48. The DIP switch 48 can be positioned to set the timing cycle of the microprocessor 38 to a desired value, and the DIP switch 48 can be used to select a desired logic for the microprocessor 38 to execute. Additionally, the DIP switch 48 may be used to select the functioning of the apparatus 10 from between a demonstration mode, a testing mode, and an operational mode. The microprocessor 38 may be equipped with software-controlled pull-ups for various inputs read from the DIP switch 48. Immediately after the position of the DIP switch 48 is read, the program turns off the pull-ups to conserve power.

The timing cycle of the apparatus 10 may be set at a value suggested by his or her physician. The apparatus 10 may be initially set in order to have a timing cycle of 30 minutes. Various timing values may be included in the logic of the microprocessor 36 and selected as desired by the DIP switch 48. Timing values of 10, 15, 20, 30, 40, 45, 50 and 60 minutes may be selected as desired. Further, in accordance with other exemplary embodiments, timing values from 5-90 minutes may be used in the apparatus 10. The microprocessor 38 can be programmed in order to employ any desired timing value for alerting the individual 11 by the indicator 40.

The apparatus 10 may alert the individual 11 though parameters based solely upon time and inclination. As such, in some exemplary embodiments, the individual 11 may exert varying amounts of pressure onto the seat 14 of the wheelchair 12 without causing any disruption in the timing cycle or functioning of the apparatus 10. In this regard, the apparatus 10 monitors the position of the wheelchair 12 and not the position of the individual 11 within the wheelchair 12.

Figure 6:
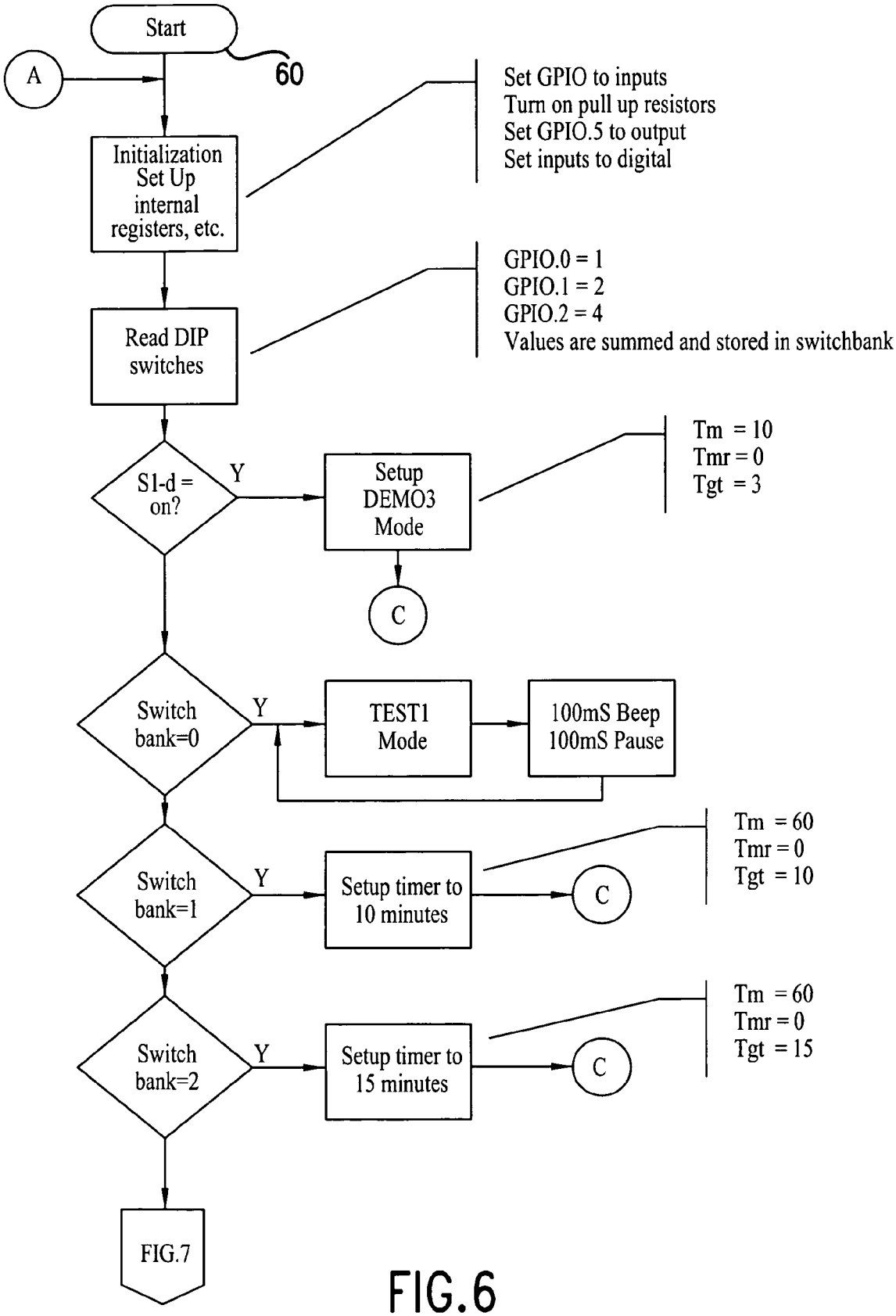
FIGS. 6-8 are flow diagrams that illustrate one exemplary embodiment of logic that is used in the pressure relief reminder.

An exemplary embodiment of logic that may be employed in the apparatus 10 is illustrated in FIG. 6. Here, a particular time value, that represents the amount of time that will lapse before the indicator 40 is actuated, is stored in a register of the microprocessor 38. Beginning with step 60 the program initializes the internal registers of the microprocessor 38. Next, the configuration switches 48 are read. Based on the values read from the switches 48, the program enters test, demonstration, or operational modes. In the case of demonstration or operational modes, the program begins executing its main loop beginning at step 62, the particulars of the mode selected having already been stored by the program in their respective registers. In the case of test modes, the program merely executes a beeping pattern in a continuous loop. The program will continue executing the test pattern until reset.

Figure 7:
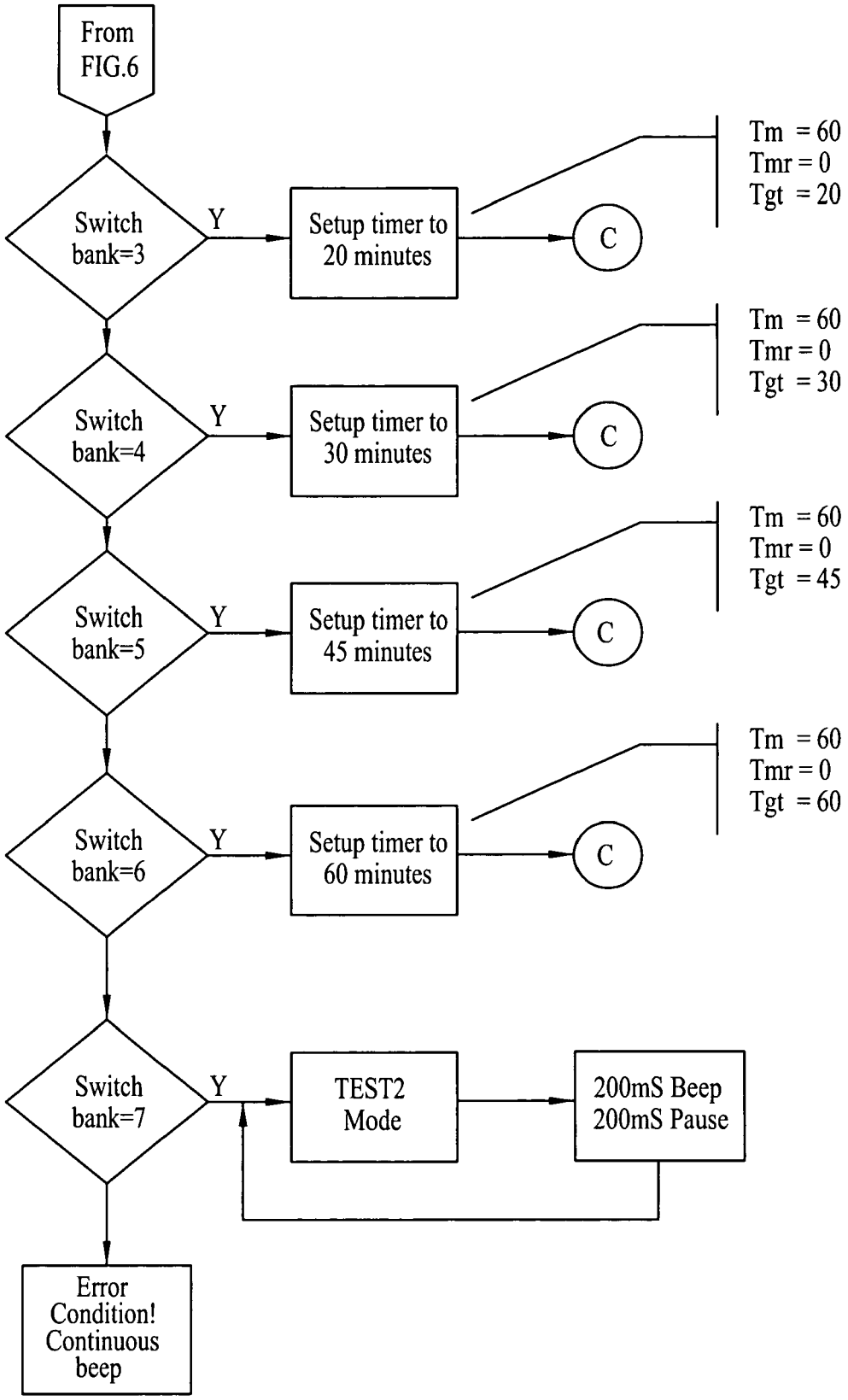

As shown in FIGS. 6 and 7, register tmr represents the elapsed time in minutes since the last reset. Register tgt represents the timing interval as programmed by the configuration switches 48. Register tm represents the time base used. In all operational modes, this is set to 60 seconds. This is used to instruct the microprocessor 38 as to the amount of time, in seconds, to "sleep" before continuing execution of the main loop.

Figure 8:
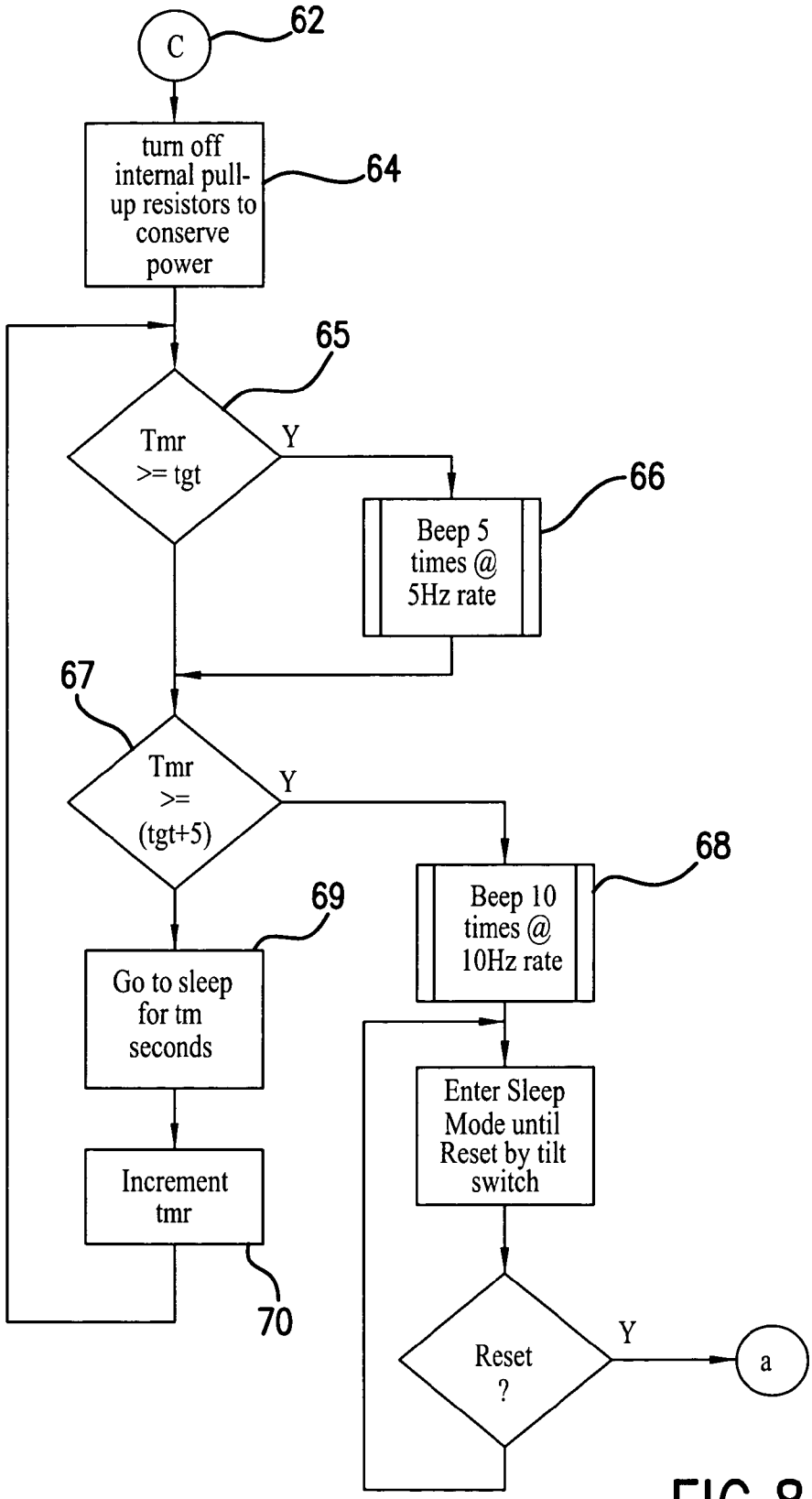

Once the main loop is entered, the execution is as follows: First, the internal pull-up resistors are turned off to conserve power (step 64 in FIG. 8). Next, register tmr is compared to register tgt (step 65). If register tmr is greater than or equal to register tgt, an alert is issued to the patient by indicator 40 (step 66). Otherwise, the program continues to step 67 where the registers are once again compared. If register tmr is greater than or equal to register (tgt+5), the program will alert the patient by indicator 40 that it will be entering the shut down mode. If the shut down mode is entered all further alerts are inhibited and the apparatus enters a low power state to conserve battery power until the device is reset by tilt switch 56. Once reset by tilt switch 56, the program begins execution at step 60.

Step 69 is executed if step 67 evaluates false. Here the microprocessor 38 is put into a sleep mode for the number of seconds stored in register tm. Typically, this value is 60 for all operational modes. Internally, the microprocessor "wakes up" every 270 mS or so to check its internal clock and determines if the sleep mode has elapsed. If not, it returns to sleep. Otherwise execution continues at step 70 where the register tmr is incremented. The program then immediately loops back to step 65 and continues execution there.

The logic of the apparatus 10 can be arranged in a variety of manners to allow for additional functionality. For example, the amount of time that the wheelchair 12 is placed into the tilted position can be monitored. In this regard, once the wheelchair 12 is tilted for a certain length of time, the indicator 40 can sound an alert to inform the individual 11 that it is time to return the wheelchair 12 to the tilted position. Further, in certain embodiments, an audible alert may be issued in order to inform the individual 11 that it is time to tilt the wheelchair 12 while a vibratory alarm is commenced in order to inform the individual 11 that it is time to stop the weight shift and return the wheelchair 12 to the nontilted position.

Although described as being used in conjunction with a wheelchair 12, the apparatus 10 can be used with a variety of items that support an individual 11 and have a tilting feature for relieving pressure on some portion of the individual's body. The apparatus 10 could be used with a bed or a day night patient bed chair. For example, in accordance with one exemplary embodiment, the apparatus 10 is used with the adjustable day night patient bed chair as shown in U.S. Pat. No. 5,230,113, the entire contents of which are incorporated by reference herein in their entirety for all purposes.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. An apparatus for preventing the formation of pressure sores on the skin of an individual, comprising:

an inclination sensor for detecting a change in inclination from an initial nontilted position to a subsequent tilted position;

a microprocessor in communication with said inclination sensor, said microprocessor configured for generating an indication signal at the end of a timing cycle and said microprocessor configured for resetting the timing cycle based upon input from said inclination sensor; and an indicator in communication with said microprocessor, said indicator configured for alerting the individual of the need to relieve pressure on certain areas of the skin of the individual upon receiving said indication signal from said microprocessor, wherein said microprocessor is configured for generating said indication signal to cause said indicator to alert the individual when said inclination sensor detects an inclination in the initial nontilted position, wherein in the initial nontilted position at the end of the timing cycle said indication signal is generated and the alert is issued by said indicator, wherein the alert is issued in the initial nontilted position;

wherein said microprocessor is configured such that subsequent to said indicator issuing the alert said inclination sensor detects a change from the initial nontilted position to the subsequent tilted position that causes said microprocessor to prevent resetting of the timing cycle to prevent generation of said indication signal to prevent issuing of the alert when in the tilted position; and wherein said microprocessor is configured for resetting the timing cycle subsequent to detecting the tilted position by said inclination sensor to generate a subsequent indication signal to cause said indicator to issue a subsequent alert when said inclination sensor indicates a change from the tilted position back to the initial nontilted position without the need to manually reset the timing cycle, wherein the subsequent alert is issued in the initial nontilted position.

2. The apparatus as in claim 1, further comprising:

a battery that supplies power to said microprocessor; and a voltage regulator that regulates voltage from said battery to said microprocessor such that the voltage is reduced from said battery to said microprocessor.

3. The apparatus as in claim 1, wherein said inclination sensor is a tilt switch.

4. The apparatus as in claim 1, wherein said inclination sensor is an accelerometer.

5. The apparatus as in claim 1, wherein generation of the indication signal is based solely upon the parameters of time and inclination.

6. The apparatus as in claim 1, wherein resetting of the timing cycle is based solely upon input from said inclination sensor.

7. The apparatus as in claim 1, further comprising a frame that carries said inclination sensor, said microprocessor, and said indicator, and wherein said frame is configured for attachment to a wheelchair.

8. An apparatus for preventing the formation of pressure sores on the skin of an individual, comprising:

an inclination sensor for detecting a change in inclination;

a microprocessor in communication with said inclination sensor, said microprocessor configured for generating an indication signal at the end of a timing cycle and said microprocessor configured for resetting the timing cycle based upon input from said inclination sensor;

an indicator in communication with said microprocessor, said indicator configured for alerting the individual of the need to relieve pressure on certain areas of the skin of the individual upon receiving said indication signal from said microprocessor; and a frame that carries said inclination sensor, said microprocessor, and said indicator, and wherein said frame is configured for attachment to a wheelchair; wherein:

said inclination sensor, said microprocessor, and said indicator are carried by a printed circuit board that is carried by said frame;

wherein said inclination sensor is a tilt sensor that is mounted at an angle on said printed circuit board; and wherein said frame is attachable to the wheelchair through use of a hook and loop type fastener.

9. The apparatus as in claim 1, further comprising a DIP switch in communication with said microprocessor, wherein said DIP switch is configured for selecting the length of the timing cycle.

10. An apparatus for preventing the formation of pressure sores on the skin of an individual, comprising:

a frame configured for attachment to a wheelchair capable of moving from a nontilted position to a tilted position such that said frame is capable of moving from a nontilted position to a tilted position;

an inclination sensor carried by said frame, said inclination sensor configured for detecting a change in inclination;

a microprocessor carried by said frame and in communication with said inclination sensor, said microprocessor configured for generating an indication signal at the end of a timing cycle, wherein said microprocessor receives input from said inclination sensor for determining inclination information of said frame;

an indicator in communication with said microprocessor, said indicator configured for alerting the individual upon receiving said indication signal from said microprocessor of the need to tilt the wheelchair in order to relieve pressure on certain areas of the skin of the individual; and a battery carried by said frame, wherein said battery supplies power to said microprocessor;

wherein said microprocessor prevents the indication signal from being generated when said frame is in the tilted position, and wherein the timing cycle is reset after said frame moves from the nontilted to the tilted position.

11. The apparatus as in claim 10, wherein generation of the indication signal is based solely upon the parameters of time and inclination of said frame.

12. An apparatus for preventing the formation of pressure sores on the skin of an individual, comprising:

a frame configured for attachment to a wheelchair capable of moving from a nontilted position to a tilted position such that said frame is capable of moving from a nontilted position to a tilted position;

an inclination sensor carried by said frame, said inclination sensor configured for detecting a change in inclination;

a microprocessor carried by said frame and in communication with said inclination sensor, said microprocessor configured for generating an indication signal at the end of a timing cycle, wherein said microprocessor receives input from said inclination sensor for determining inclination information of said frame;

an indicator in communication with said microprocessor, said indicator configured for alerting the individual upon receiving said indication signal from said microprocessor of the need to tilt the wheelchair in order to relieve pressure on certain areas of the skin of the individual; and a battery carried by said frame, wherein said battery supplies power to said microprocessor, wherein:

said inclination sensor, said microprocessor, and said indicator are carried by a printed circuit board that is carried by said frame;

wherein said inclination sensor is a tilt sensor that is mounted at an angle on said printed circuit board; and wherein said frame is attachable to the wheelchair through use of a hook and loop type fastener.

13. A method of alerting an individual of the need to tilt a wheelchair in order to prevent the formation of pressure sores on the skin of the individual, comprising the steps of:

sensing whether the wheelchair is in a nontilted position;

detecting the time spent by the wheelchair in the nontilted position;

generating an indication signal based upon the expiration of a predetermined amount of time that the wheelchair is in the nontilted position;

alerting the individual through use of an indicator upon receiving said indication signal; and resetting a timing cycle after sensing repositioning of the wheelchair from a nontilted position to a tilted position and then back to a nontilted position.

14. The method as in claim 13, wherein the step of generating the indication signal is based solely upon the parameters of time and inclination.

15. The method as in claim 13, further comprising the steps of:

tilting the wheelchair to a tilted position;

sensing the repositioning of the wheelchair to the tilted position;

returning the wheelchair to a nontilted position;

sensing the return of the wheelchair to the nontilted position; and resetting a timing cycle upon returning to the nontilted position such that the generating step is performed based upon the expiration of a predetermined amount of time that the wheelchair is in the nontilted position.

16. The method as in claim 13, further comprising the step of issuing a plurality of alerts at timed intervals after receiving said indication signal.

17. The method as in claim 13, wherein the step of sensing is performed by a tilt switch.

* * * * *